United States Patent [19]

Tullman et al.

[11] Patent Number: 4,881,666

[45] Date of Patent: Nov. 21, 1989

[54] VARIABLE VOLUME CONTAINER

[76] Inventors: Robert Tullman; Stephen Tullman, both of 83 Knollwood Dr., Cherry Hill, N.J. 08002

[21] Appl. No.: 145,588

[22] Filed: Jan. 19, 1988

[51] Int. Cl.[4] ..... B65D 23/00

[52] U.S. Cl. ..... 222/386.5; 222/105; 222/564; 222/548; 222/547

[58] Field of Search ..... 222/386.5, 105, 547, 222/564, 555, 548, 189; 215/11.3, 11.5

[56] References Cited

U.S. PATENT DOCUMENTS

| | | | |
|---|---|---|---|
| 566,282 | 8/1896 | Bailey | 222/386.5 |
| 863,260 | 8/1907 | Butterfield . | |
| 2,069,033 | 1/1937 | Guenther | 222/548 |
| 2,286,797 | 6/1942 | Duerme . | |
| 2,492,327 | 12/1949 | Sheldon | 222/189 |
| 2,673,013 | 3/1954 | Hester | 222/386.5 |
| 2,679,336 | 5/1954 | Frick . | |
| 2,743,038 | 4/1956 | Ferries . | |
| 2,798,639 | 7/1957 | Urban | 222/386.5 |
| 2,820,234 | 1/1958 | Rigney . | |
| 3,091,373 | 5/1963 | Kirschenbaum | 222/547 |
| 3,134,494 | 5/1964 | Quinn | 215/11.3 |
| 3,211,348 | 10/1965 | Greer . | |
| 3,223,289 | 12/1965 | Bouet . | |
| 3,294,289 | 12/1966 | Bayne et al. | 222/386.5 |
| 3,319,837 | 5/1967 | Mueller . | |
| 3,414,165 | 12/1968 | Gooderow | 222/572 |
| 3,592,365 | 7/1971 | Schwartzman | 222/386.5 |
| 4,098,434 | 7/1978 | Uhlig . | |
| 4,120,425 | 10/1978 | Bethurum . | |
| 4,121,737 | 10/1978 | Kain . | |
| 4,142,657 | 3/1979 | Wanke . | |
| 4,154,366 | 5/1979 | Acres . | |
| 4,193,513 | 3/1980 | Bull | 222/105 |
| 4,213,545 | 7/1980 | Thompson et al. | 222/386.5 |
| 4,286,733 | 9/1981 | Weikert . | |
| 4,491,247 | 1/1985 | Nitchman et al. . | |
| 4,531,655 | 7/1985 | Putnam . | |
| 4,545,491 | 10/1985 | Bisgaard et al. . | |
| 4,555,048 | 11/1985 | Hamman et al. | 222/564 |
| 4,623,075 | 11/1986 | Riley . | |

FOREIGN PATENT DOCUMENTS

| | | | |
|---|---|---|---|
| 960535 | 6/1964 | United Kingdom | 222/386.5 |

*Primary Examiner*—H. Grant Skaggs

*Attorney, Agent, or Firm*—Schechter, Brucker & Pavane

[57] ABSTRACT

A container for dispensing carbonated beverages and fluids sensitive to oxidation is provided. The dispenser contains a follower which communicates with the ambient environment through a one-way valve. The dispenser preferably includes a liquid flow rate and a flow velocity regulator to control the rate and velocity at which liquid is dispensed therefrom.

14 Claims, 3 Drawing Sheets

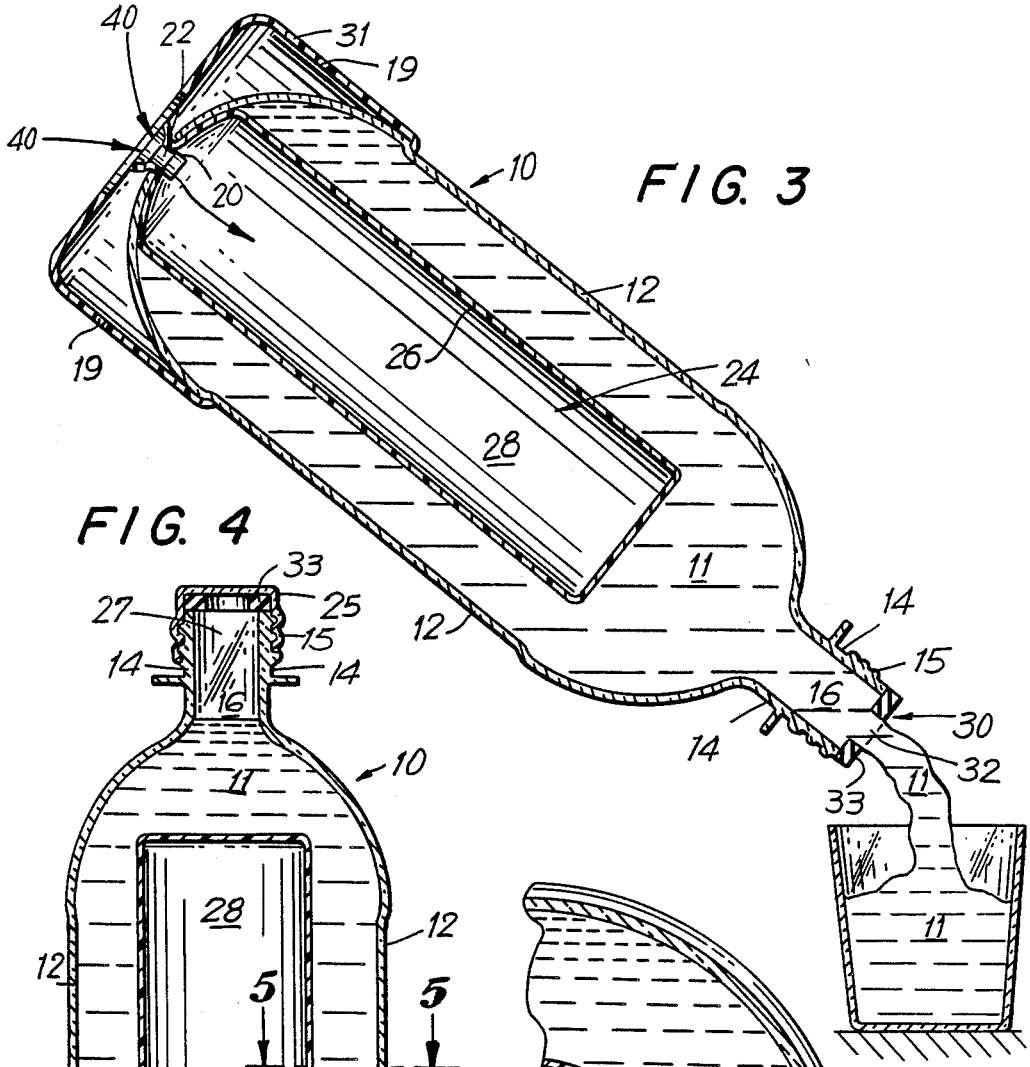
FIG. 3
FIG. 4
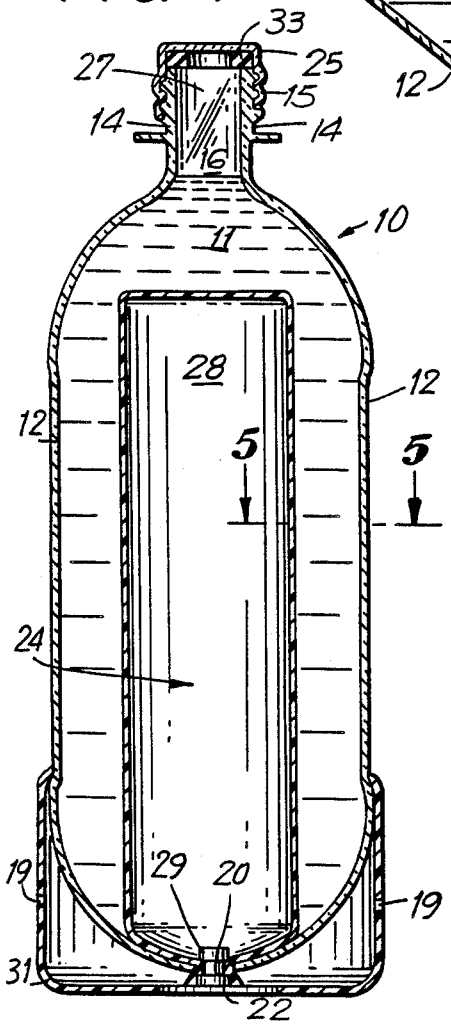
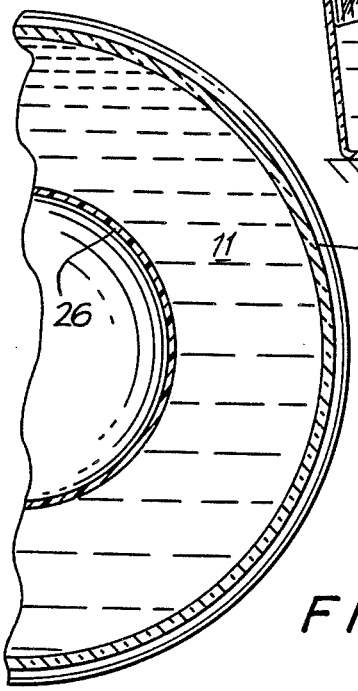
FIG. 5

FIG. 6
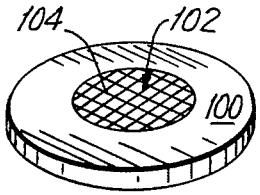
FIG. 7
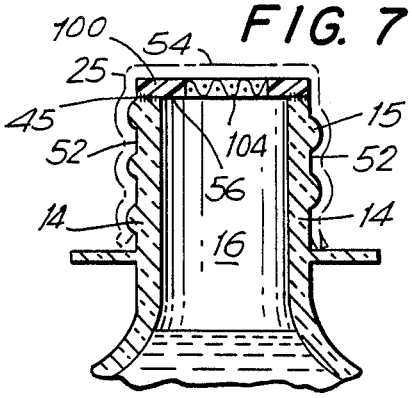
FIG. 8
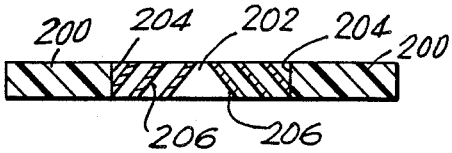
FIG. 9
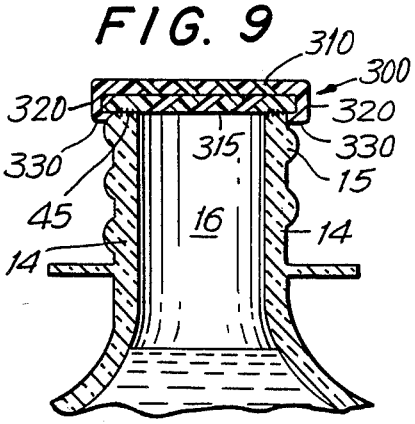
FIG. 10
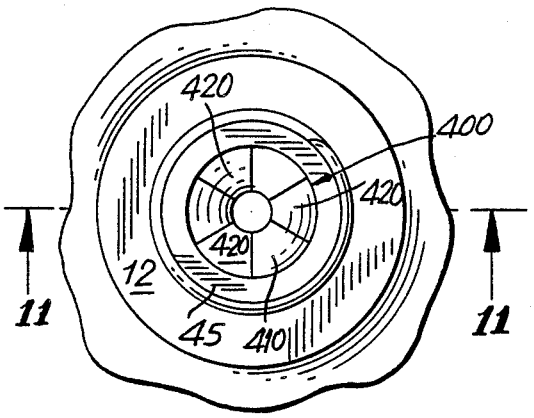
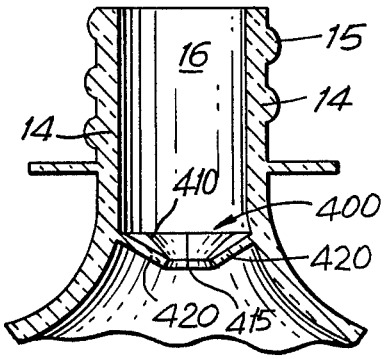
FIG. 11

VARIABLE VOLUME CONTAINER

BACKGROUND OF THE INVENTION

1. Field of the Invention

The present invention relates to a container for dispensing carbonated beverages and fluids sensitive to oxidation. More particularly, the invention pertains to dispensers capable of retaining the "fizz" in carbonated beverages and of minimizing oxidation in fluids susceptible thereto, even after the contents are partially dispensed.

2. Description of the Prior Art

Containers for receiving and dispensing fluids are well known in the art. Many designs have been developed for a multitude of functions.

For example, Putnam (U.S. Pat. No. 4,531,655) relates to a container for storing and dispensing fluids, e.g., carbonated beverages, which (with reference to FIGS. 1 and 2) consists of a rigid container 12 having a primary sealing assembly 20 and a secondary sealing assembly 26. The container 12 contains a bag 18 which is connected thereto at the top of container 12 in close proximity to the pouring end. The bag 18 contains the fluid and is connected to the rigid container at a centrally positioned point at its lower end. A slot 42 projects through opening 46 to close bag 18. The container 20 has a pressure equalizing aperture 60 which permits air to enter container 12. Although the container 20 is designed to retain the "fizz" of carbonated beverages, the operation of the primary and secondary sealing assemblies 20 and 26 is complex and the fabrication costs of these assemblies is prohibitive.

Numerous squeezable containers are known for storing and dispensing fluids. For example, Acres (U.S. Pat. No. 4,154,366) relates to a resilient housing 14 (FIGS. 1–5) having an orifice 18 within which a reclosing valve 30 is positioned. A resilient membrane 12 is affixed or adjoined to the interjoining margins of the bottom of housing 14. Fluid is dispensed from the Acres container by squeezing the non-rigid side walls of housing 14 to force fluid through a discharge orifice 19. As the presence is released from the side walls, air may be drawn through orifice 18 and reclosing valve 30 into housing 14 below membrane 12. However, as is readily apparent in the embodiment of FIG. 7, air is at least as likely to enter housing 14 above membrane 12 through discharge orifice 19 as through orifice 18. In the alternate embodiment of FIG. 6 (col. 2, lines 35–40), the bias of lips 23 to the closed position would prevent fluid from being dispensed from housing 14 without the exertion of pressure on the non-rigid side walls. Therefore, housing 14 is ill-suited and ineffective for retaining the "fizz" in carbonated beverages and dispensing beverages therefrom. Similar containers are disclosed by Mueller in U.S. Pat. No. 3,319,837, Bouet in U.S. Pat. No. 3,223,289, and Butterfield in U.S. Pat. No. 863,260.

Another fluid container is taught by Wanke in U.S. Pat. No. 4,142,657. With reference to FIGS. 1–7, Wanke shows a container having a plunger 44 hich maintains a follower bag 50 within an annular skirt 22 until fluid is dispensed from the container. The follower bag 50 is released by the plunger 44 and drawn downward by gravity until it rests on the fluid within the container. An open channel 49 communicates from follower bag 50 through pouring spout 40 and optionally through a one-way valve (not pictured) to the atmosphere. However, it is apparent that the Wanke container may not be stored on its side because pour spout 40 would thereby be unblocked (col. 5, lines 3–10), and that there is no positive closure for the fluid pouring spout. Thus, gases may readily communicate with the fluid within the container. Moreover, the undeployed portion of follower bag 50 is apt to block pour spout 40 when attempting to disperse fluid therethrough. A similar container is disclosed by Duerme in U.S. Pat. No. 2,286,797.

SUMMARY OF THE INVENTION

The present invention provides an improved container for receiving and dispensing liquids, particularly carbonated beverages, e.g., soda, and liquids sensitive to oxidation, e.g., photographic chemicals, or other fluids sensitive to contact with any ambient. The container comprises substantially rigid walls, a base having an aperture in which a one-way valve is fixed, and an orifice in the face opposite the base for receiving and dispensing the liquid. The one-way valve communicates with a collapsible, substantially gas-impermeable follower, which may be a bag, positioned within the container and preferably inflatable to substantially fully occupy the container volume. The container may further comprise a flow regulator means, possibly adjustable, to enhance the operation of the container and to control the flow rate and velocity of the fluid being dispensed.

The follower is adapted to be inflated with air which flows through the one-way valve at one end of the container as liquid is dispensed through the container orifice at the other end. The inflatable follower maintains the headspace above the liquid in the container at a minimum as liquid is dispensed therefrom. By maintaining a small headspace, the container retains the "fizz" in carbonated beverages and minimizes oxidation in liquids sensitive thereto.

Further features and advantages of the present invention will be more fully apparent from the following detailed description and annexed drawings of the presently preferred embodiments thereof.

BRIEF DESCRIPTION OF THE DRAWINGS

In the drawings:

FIG. 3 is a sectional side view of the container dispensing liquid into a glass;

FIG. 4 is a sectional side view similar to FIG. 1 but showing the container only partially filled;

FIG. 5 is a partial sectional view of the container of FIG. 4 taken along line 5—5;

FIG. 6 is a perspective view of a flow regulator of the present invention;

FIG. 7 is a partial sectional view of the container of the present invention with the flow regulator of FIG. 6, and a cap shown in phantom;

FIG. 8 is a sectional side view of an alternative flow regulator;

FIG. 9 is a partial sectional side view of another alternative flow regulator mounted on the container of the present invention;

FIG. 10 is a partial top view of yet another flow regulator attached to the container of the invention; and FIG. 11 is a partial sectional side view of the container and flow regulator of FIG. 10 taken along 11—11.

DESCRIPTION OF THE PREFERRED EMBODIMENTS

Figure 1:
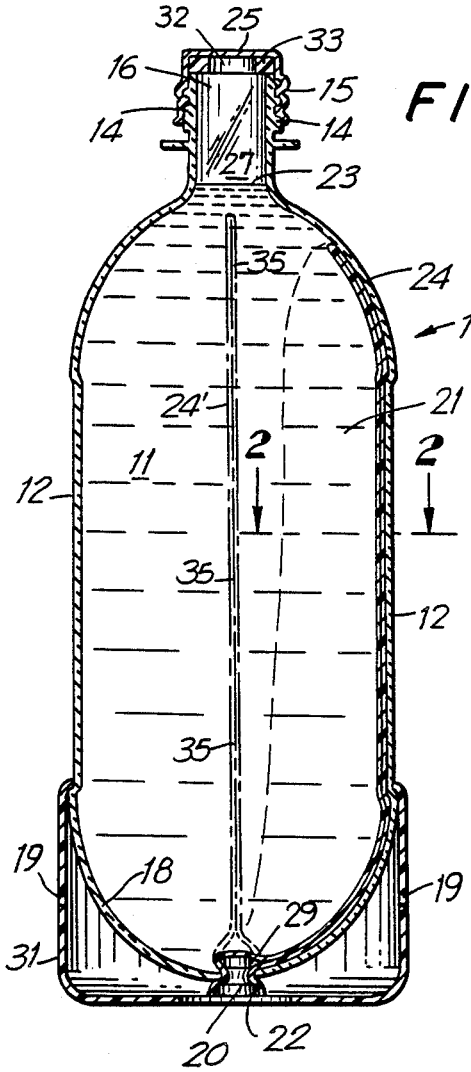
FIG. 1 is a sectional side view of a container of the present invention shown filled with a carbonated beverage.

Referring now to the drawings, a preferred container in accordance with the present invention is shown in FIGS. 1–5 and generally designated by the reference numeral 10, the container 10 defining an internal volume 21 for receiving and dispensing a carbonated beverage or a liquid sensitive to oxidation. The container 10 comprises a base 18 joined to a cylindrical sidewall 12 which tapers inwardly towards the top to form a neck 14 defining a tubular passage 16. The neck 14 has external threads 15 along a portion of its outer surface for receiving an internally threaded cap 25. The container 10 includes a base support 31 at the bottom thereof which surrounds the rounded base 18 to allow the container 10 to stand upright. The container 10 is substantially rigid and comprised, for example, of polyethylene terephthalate (PET). By substantially rigid it is meant that the container 10 is comprised of any material that will not collapse inward as liquid is dispensed therefrom. As thus far described, the container 10 is conventional.

In accordance with the invention, a flow regulator 30 is disposed in the neck 14 of the container 10. As discussed below, the flow regulator 30 may take many forms. However, for purposes of the present discussion, the flow regulator 30 comprises a disc-shaped member 33 having a flow orifice 32 substantially at its center and is preferably disposed at the top of the neck 14. The size of the flow orifice 32 provides means for regulating the flow rate of liquid 11 as it is dispensed from container 10. The reason for this will be more fully explained below. The disc-shaped member 33 may be constructed of rubber, plastic or other like material, and its disposition at the top of the neck 14 is preferred as this provides improved sealing of the container 10 when the cap 25 is threaded onto neck 14. The exit velocity of the dispensed liquid may be controlled by providing a flow impediment in conjunction with or independent from the flow regulator 30, as is described in more detail below with reference to FIGS. 6–11.

If separately formed, the flow regulator 30 is preferably fixed to the neck 14 of the container 10 prior to filling the container, though it may be fixed to the container 10 thereafter. For example, and as illustrated in FIG. 7, the flow regulator 30 may initially be loosely held within the cap 25 (shown in phantom) which, as shown, has an internally threaded sidewall 52 and a top wall 54. After the container 10 is filled, the cap 25 is joined to the container by screwing the cap 25 onto the neck 14 whereupon one face 56 of the flow regulator 30 is brought into partial contact with the lip 45 of the neck 14. A suitable adhesive, e.g., a thermosetting glue, is applied to the lip of the neck 14 and/or the contacting portion of face 56 of the flow regulator 30 and heated prior to securing cap 25 onto neck 14. Thus, screwing the cap 25 onto the container 10 causes the flow regulator 30 to adhere to the neck 14 whereupon the flow regulator stays in place even when the cap is subsequently removed. This description is merely illustrative of one method by which a suitable flow regulator may be affixed to a container in accordance with the invention, and alternative methods will be readily apparent to those with ordinary skill in the art once this description is known.

As best seen in FIGS. 1, 3 and 4, a one-way valve 22 is fixed in an aperature 20 in the base 18, preferably at the center thereof. The valve 22 is selected from among one-way valves known in the art and may, for example, comprise an MPC Check Valve manufactured by Minature Precision Components, Inc., which operates on a pressure differential as low as ½" water pressure. For reasons that will become apparent below, one or more openings 19 are provided in base support member 31 to allow communication between valve 22 and the environment external to container 10. Of course, where the base 18 of the container 10 is shaped to permit the container to stand upright without the base support member 31, the base support member 31 and the openings 19 therein may be dispensed with. In such an embodiment, it is contemplated that the central portion of the base 18 is constructed such that the valve does not interfere with the stability of the container 10 when it is in the upright position, e.g., the base 18 is concave such that the valve 22 does not contact the supporting surface.

Figure 2:
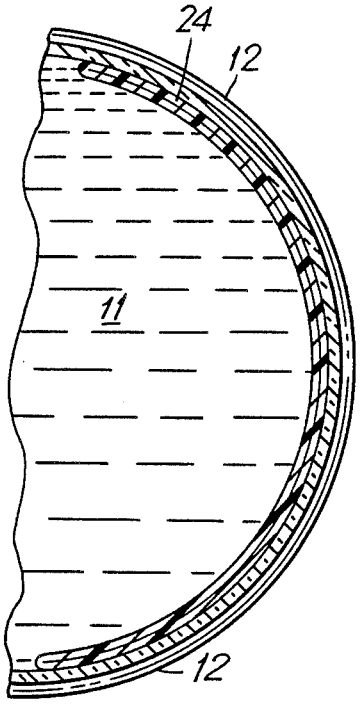
FIG. 2 is a partial sectional view of the container of FIG. 1 taken along line 2—2.

Within the container 10 is a follower 24 which comprises a gas-impermeable flexible member, e.g., metalized polyester or other material, e.g., a plastic bag 26. As shown in FIGS. 1 and 2, when the container 10 is substantially filled with liquid the bag 26 is collapsed, e.g., against the inner wall of container 10, though it will be apparent that the precise manner in which the bag 26 collapses when the container 10 is filled with liquid 11 will be dependent upon the material of the follower 24. Preferably, and as shown in phantom in FIG. 1, follower 24 collapses substantially along the longitudinal axis of the container. For example, as shown in FIG. 1, this may be accomplished by providing follower 24 with a plurality of longitudinally extending elastic stiffeners 35. In this way, as best seen in FIG. 4, the follower will fill along its vertical axis initially, and subsequently in a radial direction so that a low center of gravity for the container is maintained when the container is in the upright position. Accordingly, the container will remain stable in the upright position, whereas it would be unstable if all the liquid were in the top of the container with the air-filled bag 26 therebeneath.

The follower 24 is sufficiently flexible and/or expandable such that when collapsed it occupies little of the interior volume 21 of container 10 (FIG. 1) and when filled with air occupies substantially the entire volume 21. Consequently, and as most readily seen in FIGS. 3 and 4, the follower 24 defines a variable enclosed volume 28. As best seen in FIGS. 1–4, the follower 24 has an opening 29 at one end secured about the one-way valve 22 for communicating the volume 28 with the environment exterior to the container 10 when the one-way valve 22 is opened. For example, where the follower 24 comprises a bag 26, the portion of the bag 26 defining the opening 29 may be secured to the valve 22 about its orifice by a thermosetting glue, an O-ring, pinching the open end of the bag between the valve 22 and the defining wall of the opening 29, or by other techniques well known in the art. Suffice it to say that the seal between the bag 26 and the valve 22 must be airtight such that air entering through valve 22 fills the bag 26 but does not enter the space between the bag 26 and the defining walls of the container 10.

As shown in FIG. 1, a liquid 11 initially fills the container volume 21 to a level 23. Thus filled, the region above the liquid level 23 within the neck 14 of container 10 and below the cap 25 constitutes a headspace 27 which is filled by gas. The headspace 27 initially contains air but it may be purged of oxygen and other deleterious gases before the container 10 is closed by cap 25, as for example by purging the headspace 27 with a gas, e.g., carbon dioxide, and optionally providing a pressurized state within the container 10 by the introduction of pressurized inert gas, e.g., carbon dioxide at 80 psi. Regardless of whether the headspace 27 is initially purged, after the liquid 11 is added to the container 10 and the cap 25 is placed thereon, a vapor-liquid equilibrium is established in headspace 27. For example, if the liquid 11 is a carbonated beverage, the headspace 27 contains an equilibrium partial pressure of carbon dioxide which is dependent upon parameters such as temperature and pressure. That is, a vapor-liquid equilibrium is established in the headspace 27 and the amount of each component in each phase (vapor and liquid) is determined by temperature, pressure, volumes of each phase, number of moles of each component, and thermodynamic properties of each component. Inasmuch as carbon dioxide is less soluble in an aqueous solution than in air, minimizng the air volume helps to maintain the carbon dioxide dissolved in the aqueous solution. Similarly, minimizing the ambient air volume reduces the amount of oxygen dissolved in the liquid aqueous phase.

In operation, and as best shown in FIG. 3, the liquid 11 is dispensed from the container 10 in a conventional manner by removing cap 25 from neck 14 and tilting the container 10 such that the orifice 32 is above, e.g., a glass 50. Liquid 11 then flows through the passage 16 in neck 14, out through the orifice 32, and into the glass 50. As liquid 11 exits orifice 32, air 40 is simultaneously drawn into the bag 26 through the one-way valve 22. The mechanism by which air is drawn through valve 22 into the bag 26 is the pressure differential which forms between the environment exterior to the container 10 and the partial vacuum formed behind the liquid 11 during the pouring process. As is known for conventional beverage containers, liquid is dispensed from a conventional container in intermittent slugs because air must simultaneously enter the container through the pouring orifice to fill the void which is created by the exiting liquid. However, in the present invention, the aforementioned pressure differential results in air being drawn through the valve 22 into the bag 26. The air 40 entering the bag 26 is retained therein by the substantially gas-impermeable walls thereof and by the one-way valve 22 which closes when the pressure differential equilibrates.

As noted above, the maintenance of a minimal headspace 27 within the container 10 is particularly advantageous for carbonated beverages and liquids sensitive to oxidation. As will be readily apparent to one with ordinary skill in the art, the greater the headspace 27 above the liquid 11, the more rapidly the liquid 11 will lose its carbonation and/or oxidize. For example, if, as is true of conventional containers for carbonated beverages, the headspace 27 increases as the beverage volume decreases, the beverage goes "flat" relatively quickly, whereas the container of the invention keeps the "fizz" in the beverage much longer, due to the maintenance of a minimal headspace. As will also be readily apparent, the container of the present invention may also be advantageously employed with other liquids, e.g., flammable liquids, which benefit from a controlled headspace.

As shown in FIG. 4, when the container 10 is returned to its upright position the headspace 27 above liquid 11 is still minimal since, in accordance with the invention, the liquid volume dispensed from the container is replaced by the air 40 which enters and expands the bag 26.

As is well known, and as briefly described above, the liquid flow from conventional rigid containers is inherently regulated by the fact that air must simultaneously enter the pouring orifice to replace the resulting void. Thus, the liquid flows out in slugs. However, in the present invention, the void which is created by the exiting liquid is filled by air 40 which enters the bag 26 through the one-way valve 22. As a result, the liquid flow rate and velocity are not limited by air entering the container through the flow orifice. Consequently, in the present invention, the liquid flow rate is dependent only upon the cross-sectional area available for flow and the liquid velocity. See generally "Process Fluid Mechanics," Morton M. Denn, Prentice Hall, Inc., pp. 112–114, hereby incorporated by reference. With a pouring orifice sized in accordance with conventional 2 liter containers for carbonated beverages, i.e., orifices having a diameter of about 22 mm, the liquid flow rate for a container in accordance with the invention would be quite high. For this reason, the flow regulator 30 having a reduced diameter orifice 32 of about a 10 mm diameter is preferably included. Use of the container 10 is thus enhanced by the reduced diameter orifice 32 because the liquid flow rate from the container 10 is more like that of a conventional container. Other modifications which effectively reduce the cross-sectional area available for flow will also suffice.

Use of the container 10 is further enhanced by means for regulating the velocity of liquid dispensed therefrom. The fluid velocity as it is dispensed from the container 10 is determined primarily by the pressure drop across the orifice 32 and the geometry of the orifice 32. In order to reduce the velocity of the liquid, it is necessary to dissipate some of the energy, i.e., kinetic energy, as the liquid is dispensed from the container 10. Perhaps the easiest way to dissipate some of the liquid's kinetic energy is through viscous loss, typically in the form of turbulence. Thus, as shown in FIGS. 6–11, means for regulating the liquid flow rate, flow velocity, and preferably both, as liquid is dispensed from the container 10 may take many forms.

For example, as shown in FIGS. 6–7, the liquid flow rate and flow velocity regulating means may comprise a disc-like member 100 having an orifice 102 adapted to fit within or mount on the container lip 45. The orifice 102 provides a reduced cross-sectional area, thereby reducing the liquid flow rate as liquid is dispensed from the container 10. As seen in FIGS. 6 and 7, a screen or grating 104 across the flow path, e.g., perpendicular to the direction of liquid flow, creates turbulence and therefore provides means for regulating the liquid velocity.

Alternatively, as shown in FIG. 8, a disc-like member 200 having an orifice 202 bounded by cylindrical wall 204 is fitted with blades or vanes 206 in angular relation to the flow path, i.e., in angular relation to the longitudinal axis of the container 10. The vanes 206 provide means for regulating flow velocity. As also seen in FIG. 8, the disc-like member 200 and the vanes 206, which reduce the effective cross-sectional area formed by cylindrical wall 202, additionally provide means for regulating the liquid flow rate.

In another embodiment, as shown in FIG. 9, multiple cooperating discs 300 may be mounted on the lip 45 of the neck 14, e.g., by affixing a bottom disc 315 to the lip 45 with a thermosetting glue. In this embodiment, top disc 310 has a radially extending edge face 320 which combines with an inwardly extending integral lower face 330 to form an L-shaped member. The lower face 330 secures the top disc 310 to the bottom disc 315. Thus, the top disc 310 is rotatable on bottom disc 315. Discs 310 and 315 are preferably each provided with vanes 350 in angular relation to the liquid flow path. Thus, rotation of top disc 310 on bottom disc 315 provides multiple vane geometries which result in varying liquid flow rates and flow velocities.

Still another embodiment is shown in FIG. 10, wherein a flow regulator 400 is mounted within the container neck 14. The flow regulator 400 comprises an inwardly extending lip 410 having an orifice 415 at substantially the center thereof. Preferably the lip 410 comprises a series of abutting petal-like members 420 which are deflected easily toward the inside of the container 10, i.e., deflected more easily toward the inside than toward the outside of the container, thus permitting liquid to flow easily into the container 10 for filling. However, liquid flow out of the container is impeded by the petal-like members 420, thus controlling the exit velocity and flow rate of the liquid.

The invention has thus been described with reference to various illustrative embodiments and examples. Of course, other changes to the dispenser of the present invention will suggest themselves to the person of ordinary skill in the art once this description is known. Accordingly, the above description should be construed as illustrative, and not limitative, of the scope of the invention being defined by the following claims.

We claim:

1. A liquid dispenser which comprises:

a rigid container defining a volume for said liquid, said container having a pouring orifice and an aperture;

a flexible, gas impermeable follower disposed in said container for defining a variable volume, said follower having an opening at one end; and a valve secured in said aperture in said container with said open end of said follower secured about said valve for providing communication between ambient atmosphere and said variable volume when said valve is open, said valve moving to said open position when a pressure differential is established between ambient atmosphere and said container volume as liquid is dispensed through said orifice, whereupon ambient gas enters and expands said follower solely by virtue of said pressure differential, said valve moving to a closed position when liquid dispensing ceases and said pressure differential diminishes for substantially retaining said gas in said follower, whereby said gas filled follower substantially fills the container volume vacated by dispensed liquid, thereby minimizng the headspace in said container even after the contents thereof are partially dispensed.

2. The liquid dispenser according to claim 1, wherein said pouring orifice is in the upper portion of said container and said aperture is in the lower portion of said container and said container comprises a bottom for supporting said container in an upright position and a vertical sidewall having a height greater than the width of said bottom, and further comprising means for retaining a portion of said gas filled follower in the upper part of said container volume even after liquid has been partially dispensed therefrom, thereby allowing liquid remaining in said container to return to the lower part of the container volume when said container is returned to said upright position for maintaining a center of gravity for said container in which said container is stable in said upright position.

3. The liquid dispenser according to claim 2, wherein said retaining means for said follower comprises said follower incorporating means offering a lower resistance to enlargement of said variable volume of said follower along the direction of the vertical axis of the container than in the width-wise direction thereof.

4. The liquid dispenser according to claim 1, further comprising means for regulating the velocity of liquid dispensed from said container.

5. The liquid dispenser according to claim 4, wherein said flow velocity regulating means comprises a member disposed in said pouring orifice for partially obstructing flow therethrough, thereby dissipating a portion of the kinetic energy of the liquid.

6. The liquid dispenser according to claim 4, further comprising means for regulating the flow rate of liquid dispensed from said container.

7. The liquid dispenser according to claim 6, wherein the upper portion of said container includes a narrowed neck portion defining said pouring orifice, and wherein said means for regulating the flow rate of said dispensed liquid comprises a member disposed in said pouring orifice having an opening of reduced cross section relative to said pouring orifice.

8. The liquid dispenser according to claim 7, wherein said member disposed in said pouring orifice further comprises a grating across said opening of reduced cross-section.

9. The liquid dispenser according to claim 7, wherein said member disposed in said pouring orifice further comprises vanes positioned across said opening of reduced cross-section in angular relation to the longitudinal axis of said dispenser.

10. The liquid dispenser of claim 6, wherein said means for regulating liquid velocity and said means for regulating liquid flow rate comprise a top disc member and a bottom disc member, each disc member having vanes in angular relation to the longitudinal axis of the container, said top disc member being rotatable on said bottom disc member.

11. The liquid dispenser to claim 6, wherein said means for regulating liquid velocity and said means for regulating liquid flow rate comprise a lip mounted to the container, said lip comprising abutting petal members which are easily deflected toward the inside of the container.

12. The liquid dispenser according to claim 1, further comprising means for regulating the flow rate of liquid dispensed from said container.

13. The liquid dispenser according to claim 12, wherein the upper portion of said container includes a narrowed neck portion defining said pouring orifice, and wherein said means for regulating the flow rate of said dispensed liquid comprises a member disposed in said pouring orifice having an opening of reduced cross section relative to said pouring orifice.

14. The liquid dispenser according to claim 1, further comprising a removable cap securable over said pouring orifice.

* * * * *